United States Patent [19]

Grooten

[11] 4,439,633

[45] Mar. 27, 1984

[54] CORROSION RESISTANT ARMORED CABLE AND METHOD OF MANUFACTURING SAID CABLE

[75] Inventor: Albertus T. M. Grooten, Waddinxveen, Netherlands

[73] Assignee: N.K.F. Groep B.V., Netherlands

[21] Appl. No.: 433,750

[22] Filed: Oct. 8, 1982

[30] Foreign Application Priority Data

Oct. 14, 1981 [NL] Netherlands ..... 8104667

[51] Int. Cl.[3] ..... H01B 7/22

[52] U.S. Cl. ..... 174/106 R; 156/53; 156/56; 174/102 A; 174/109

[58] Field of Search ..... 174/102 A, 106 R, 106 D, 174/108, 109; 156/53, 56

[56] References Cited

U.S. PATENT DOCUMENTS

| | | | |
|---|---|---|---|
| 312,673 | 2/1885 | Thompson | 174/109 |
| 451,605 | 5/1891 | Andrews | 174/106 R |
| 2,041,842 | 5/1936 | Layton | 174/108 |
| 3,153,696 | 10/1964 | Blanchard | 156/56 X |

FOREIGN PATENT DOCUMENTS

| | | | |
|---|---|---|---|
| 2035666 | 6/1980 | United Kingdom | 174/106 R |
| 2037060 | 7/1980 | United Kingdom | 174/108 |
| 2080242 | 2/1982 | United Kingdom | 156/53 |

*Primary Examiner*—G. P. Tolin
*Assistant Examiner*—Morris H. Nimmo
*Attorney, Agent, or Firm*—David R. Treacy

[57] ABSTRACT

An armored cable and a method of manufacturing an armored cable, said cable having a helically wrapped zinc-plated steel armor. The steel armor band has zinc protective layer on its two sides, and uncoated edges, to reduce manufacturing costs and improve cathodic protection. The zinc protective layer thereby comprises a first layer portion consisting of a zinc-iron alloy and a second layer portion, on top of said first layer portion consisting of essentially pure unalloyed zinc and having a thickness of at least 90% of the total layer thickness.

5 Claims, 2 Drawing Figures

CORROSION RESISTANT ARMORED CABLE AND METHOD OF MANUFACTURING SAID CABLE

BACKGROUND OF THE INVENTION

The invention relates to flexible armored cable; and more particularly to such a cable for electric wires and the like, having a spiral armoring made of zinc plated steel. Such cables are used, for example, for electrical power transmission and for telecommunications.

Cables of this general type are constructed from a cable core, containing one or more insulated conductors, and one or more protective layers around the core. The protective layer may be manufactured from a variety of materials, such as synthetic resins or jute impregnated with bitumen, or may consist of an inner cover and a sheath. A combination of materials may be used, and to provide protection against mechanical loads and abrasion, and extra protective armoring layer is frequently provided. A common, known armor consists of one or more steel tapes or bands wound helicoidally around the cable core, and usually in turn covered by a sheath, to protect against corrosion, such that the steel tape or band does not form the outside of the cable. Nonetheless, as a result of abrasion or accident, the sheath is sometimes damaged such that the armor becomes exposed.

To avoid corrosion of the armor, even where an outer sheath is to be applied, the armor band is frequently made of a zinc-plated steel such as that prescribed in the ASTM Standard ANSI/ASTM A 459-71 (Reapproved 1975). That standard prescribes the use of thermally zinc-plated steel which is plated on all its surfaces including the edges. Because steel band is usually manufactured by cutting (slitting) or punching from steel sheet, compliance with this Standard requires that the zinc plating follow the cutting or punching operation. However, it is more economical to zinc-plate entire sheets rather than the narrow band. The usual thermally zinc-plated steel band also has the disadvantage that, upon winding the steel band around the cable core, the zinc often scales partly or entirely.

Another method of providing corrosion resistance, known from British Patent Application No. 2,060,726A, involves the use of zinc wire in a cable to protect a steel wire armoring. However, this is a relatively expensive technique that produces poorer mechanical protection.

SUMMARY OF THE INVENTION

The object of the invention is to provide a zinc-plated steel-armored cable which does not scale upon winding around a cable core, and which need not be zinc-plated on its band cutting edges so that it can be manufactured from zinc-plated steel sheet.

The invention is based on the recognition that the cause of zinc layer scaling in the prior art is that thermally zinc-plated steel of the usual qualities actually has a composite zinc layer, a greater part of whose thickness is composed of iron zinc alloys when the layer thickness is that which is usual for armored steel band. The existence of these alloys is known from the Kirk-Othmer Encyclopedia of Chemical Technology, 2nd Ed., Vol. 13, pp. 252–257. Further iron zinc alloys do not present sufficient cathodic protection for the exposed steel edge of the band, so that the cutting edges of the band must also be zinc plated.

According to the invention, an armored cable has a steel band covered by a zinc layer on each of its flat sides, the layer comprising a first layer portion consisting of a zinc-iron alloy and a second layer portion on top of said first layer portion, consisting of essentially pure unalloyed zinc in which the thickness of the second layer portion is at least 90% of the total layer thickness.

In the cable according to the invention scaling of the zinc layer does not occur and it is not necessary to zinc plate the cutting edge. As used herein and in the appended claims, essentially pure unalloyed zinc includes a layer or alloy containing approximately 0 to 0.2% aluminum or the like.

If contrary to the invention the thickness of the second layer portion is less than 90% and consequently the thickness of the first layer portion is more than 10%, a real danger of scaling exists whereby the first layer functions as the shearing or splitting layer. Also the edges of the steel band are no longer sufficiently protected cathodically so that the edges need to be zinc plated too.

In a preferred embodiment of the cable according to the invention the thickness of the second layer portion is at least 95% of the total layer thickness.

The total thickness of the protective zinc layer is from 20 μm to about 40 μm and for most practical applications amounts to 20–25 μm. At an overall layer thickness of 20–25 μm, the thickness of the first layer portion according to the above mentioned preferred embodiment is maximally 1 to 1.25 μm respectively and the thickness of the second (top) layer portion is at least 18.75 to 23.75 μm respectively.

In a further preferred embodiment the overall thickness of the zinc protection layer is 20–25 m, the thickness of the first layer portion is approximately 0.1–0.5 μm and the thickness of the second layer portion is approximately 19.5–24.9 μm.

The invention also relates to a method of manufacturing an armored cable, comprising:

applying onto both sides of a steel sheet a zinc protective layer such that a first layer portion consisting of zinc-iron alloy is formed and on top of said first layer portion a second layer portion consisting of essentially pure unalloyed zinc is formed whereby the thickness of the second layer portion is at least 90% of the total layer thickness, cutting said sheet into a plurality of elongated band having the zinc layer on both sides and having unprotected edges, and helically wrapping said bands about a cable so as to form an armored cable.

A zinc protective layer as defined hereabove can be applied by the so-called Sendzimir process or variations of this process, as described in Polytechnisch Tijdschrift Procestechniek, 33 (1978) No. 4, pp. 193–196). In the Sendzimir process a steel sheet is passed through a tunnel furnace, such that in the front part of the furnace the steel sheet is oxidized at its surface to form ferric oxide. In the rear part of the furnace, this oxide is reduced to metallic iron on exposure to an ammonia cracking gas. A bath of molten zinc is placed at the tunnel furnace exit, so that further oxidation of the sheet does not occur. The zinc bath preferably contains 99.99% pure zinc alloyed with 0.16–0.2% of aluminum. As a result of this coating process, a first layer portion consisting of iron-zinc alloy is formed with a thickness of 0.1 to 0.5 microns and a second (top) layer portion consisting of pure zinc with a thickness of more than 90% of the overall layer thickness such as a thickness of preferably 19.5 to 24.9 microns.

The zinc layer provided by this process provides good cathodic protection to the parts where the steel is exposed. This has the advantage that the edges of steel band exposed by cutting the band from plated sheet are protected cathodically, and therefore the edges do not need to be zinc plated.

The invention will be described hereinafter in greater detail with reference to the drawing.

DESCRIPTION OF THE PREFERRED EMBODIMENTS

Figure 1:
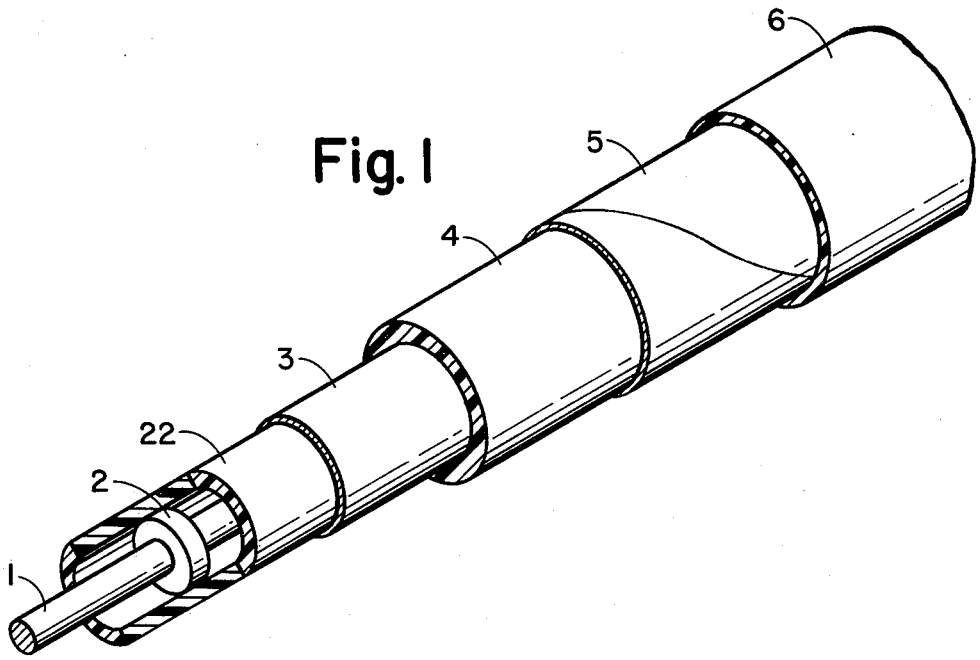
FIG. 1 is a perspective view, partially cut away, of an armored cable according to the invention.

FIG. 1 shows a coaxial cable which is one of the typical types which may be armored according to the invention. This cable has an inner conductor 1 around which a succession of insulating rings 2 are fitted, the rings 2 serving as spacers for a polyethylene tube 22. An outer conductor 3 is formed by a copper band folded around the polyethylene tube, the outer conductor being surrounded by a polyethylene inner cover 4. The inner cover is surrounded by an armor layer 5 consisting of two zinc-plated steel bands wound helically about the cable inner cover so as to overlap each other. The armoring in turn is surrounded by an outer polyethylene sheet 6.

In this embodiment, the steel bands have a Sendzimir zinc plated coating whose zinc layer has an average thickness of approximately 25 microns. The alloy layer at the steel-zinc interface is 0.1–0.5 microns thick, and the overlying zinc coating is at least approximately 99.8% zinc by weight, plus up to 0.2% aluminum.

The starting material for the armoring of the cable shown in FIG. 1 may be large sheets of zinc plated steel, from which the bands are cut. Because of the zinc coating method of the invention, upon winding these bands about the inner cover, no scaling of the zinc layer occurs.

A cable as shown in FIG. 1 and a known cable having an armor layer whose zinc layer is provided in the usual thermal plating technique, with zinc along the cutting edges, were each subjected to a corrosion test. In each case, a five cm. length of the sheath 6 was removed so that the zinc-plated steel band was exposed. This exposed or "damaged" portion was immersed in a 0.05 molar sodium sulfate solution, after the end of the cable was sealed to be water tight by a synthetic material (Araldite brand resin). The two test cables were exposed in the electrolyte solution for 2650 hours, and then removed to determine the decrease in weight of the zinc layer and permit detailed visual inspection. The sheath was entirely removed. It was found that corrosion of the zinc layers had extended under the outer sheath 6 as a result of penetration of the electrolyte between the armor layer and the inner cover 5. This corrosion was determined quantitatively by measuring the remaining zinc coating and comparing it with the original zinc coating, by the "dezincifying" method. In this test method the steel band is weighed, the zinc is then removed in a hydrochloric acid bath, and the band is then weighed a second time, the weight of zinc per surface unit being calculated from the measured loss of weight. These measurements were performed separately for the inner and the outer helical wrappings of the armor, which is described above, partially overlapped each other. Measurements were made for different portions of the armoring, as a function of the distance from the "damage" area in which the outer sheet had been removed.

The measured values of zinc loss are shown in Table I. Negative values of distance denote the "damaged" area from which the outer sheets had been removed, while positive values are distances beyond that region. In each case the original zinc coating had a weight of 210 g/m$^2$.

| Sendzimir zinc-plated steel | | | | Conventional zinc-plated steel band | | | |
|---|---|---|---|---|---|---|---|
| outer helix | | inner helix | | outer helix | | inner helix | |
| distance (cm) | zinc coating (g/m$^2$) | distance (cm) | zinc coating (g/m$^2$) | distance (cm) | zinc coating (g/m$^2$) | distance (cm) | zinc coating (g/m$^2$) |
| −13.72 | 170 | −13.81 | 166 | −23.92 | 172 | −23.66 | 182 |
| −11.91 | 153 | −11.93 | 156 | −21.84 | 171 | −21.24 | 180 |
| −9.21 | 154 | −9.04 | 151 | −19.31 | 170 | −18.97 | 179 |
| −6.84 | 159 | −6.79 | 155 | −16.68 | 173 | −16.72 | 179 |
| −3.82 | 156 | −3.61 | 163 | −14.02 | 177 | −14.44 | 179 |
| −1.54 | 161 | −1.51 | 137 | −11.71 | 173 | −11.69 | 179 |
| 0 | 88 | 0 | 107 | −8.96 | 170 | −9.04 | 180 |
| 1.88 | 137 | 1.41 | 144 | −6.77 | 179 | −6.68 | 177 |
| 4.60 | 157 | 4.32 | 147 | −3.69 | 175 | −3.74 | 183 |
| 7.41 | 158 | 6.93 | 143 | −1.18 | 168 | −1.11 | 179 |
| 9.14 | 159 | 9.38 | 148 | 0 | 115 | 0 | 159 |
| 12.32 | 162 | 12.17 | 163 | 1.75 | 164 | 1.46 | 193 |
| 13.98 | 166 | 14.41 | 154 | 4.21 | 165 | 4.21 | 188 |
| 16.20 | 159 | 17.09 | 155 | 7.32 | 170 | 6.58 | 194 |
| 18.74 | 158 | 18.98 | 154 | 9.38 | 170 | 8.94 | 180 |
| 20.95 | 147 | 22.26 | 158 | 12.08 | 171 | 12.14 | 182 |
| 23.30 | 160 | 24.93 | 160 | 14.82 | 173 | 14.98 | 183 |
| 24.96 | 163 | | | 16.29 | 172 | 15.96 | 182 |

Figure 2:
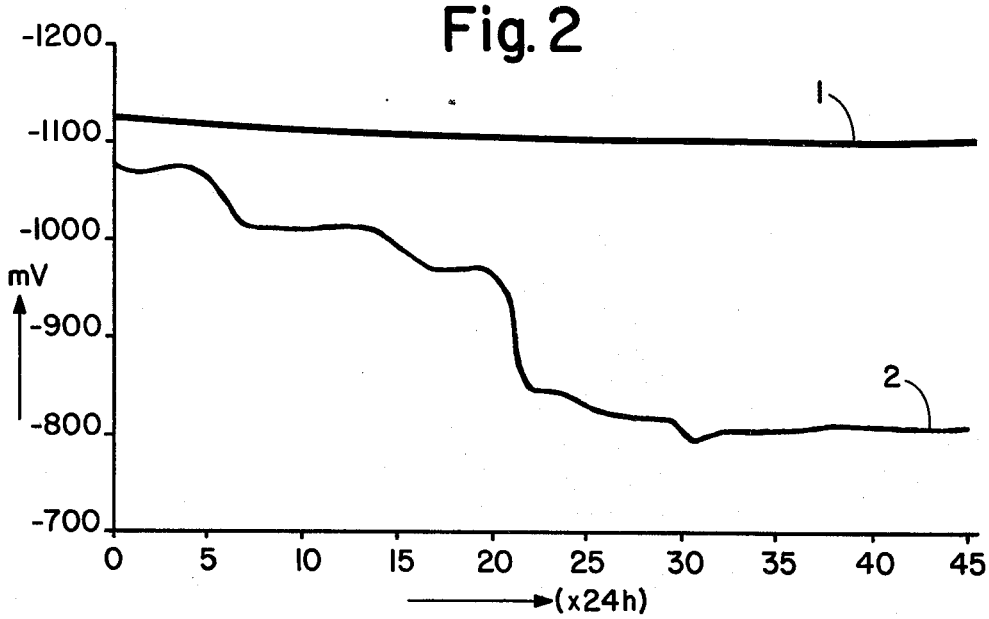
FIG. 2 is a graph of the cathodic potentials of a cable having conventional zinc plated steel armoring and that of a cable according to the invention.

During the performance of the corrosion test described above, the potential of the steel band with respect to a saturated calomel electrode was measured as a function of time, for each cable. The graph of these measurements is shown in FIG. 2, curve 1 being the values for the Sendzimir zinc-plated band having raw (no zinc coating) edges, and curve 2 being for the conventional band thermally zinc-plated on all sides and edges. After 30 days the potential of conventional zinc-plated steel had fallen to a value approximately equal to the potential of the steel substrate. From that time onward no cathodic protection is provided. In constrast, curve 1 shows that the Sendzimir plated band maintains a potential substantially equal to that of zinc for more than 45 days, so that substantially permanent cathodic protection is provided.

The values in Table 1 show that the cathodic protection is provided at the expense of the zinc layer. The Sendzimir zinc-plated band shows a larger loss of weight of zinc that the conventional zinc-plated band, but this loss of weight is distributed over a relatively large section of the length of the band, rather than being locally concentrated as in the case of the conventional plating. Thus, these tests demonstrate that the Sendzimir zinc-plated steel band, used as cable armoring, can withstand corrosion better than the conventional zinc-plated band even though the Sendzimir coated band does not have any zinc coating along the cutting edges which are generated when the band is slit from the original sheet.

It will be clear to those of ordinary skill that this invention is applicable to a broad range of cables, whether used for electric power, electric telecommunications, optical fibers, or any other transmitting medium or conduit. In fact, it appears that the invention may be beneficially applied to any armored cable having single or multiple layer wrappings of zinc-plated steel armoring. Further, it will be clear that it is the provision of a relatively thick layer of a high purity zinc layer, in contrast with the prior art layer which is substantially zinc iron alloy, which is the claimed improvement. Trace amounts of other elements, such as aluminum, may be included in the zinc to provide processing advantages.

What is claimed is:

1. A cable comprising an armoring of a zinc-plated steel band in which the steel band comprises a zinc protective layer on the flat sides only of the band, said protective layer comprising a first layer portion consisting of a zinc iron alloy and a second layer portion on top of said first layer portion, consisting of essentially pure unalloyed zinc in which the thickness of the second layer portion is at least 90% of the total layer thickness.

2. A cable as claimed in claim 1 wherein the thickness of the second layer portion is at least 95% of the total layer thickness.

3. A cable as claimed in claim 1 wherein the protective layer has a thickness of approximately 20–25 μm, the first layer portion has a thickness of approximately 0.1–0.5 μm and the second layer portion has a thickness of approximately 19.5–24.9 μm.

4. A method of manufacturing an armored cable, comprising:

applying onto both sides of a steel sheet a zinc protective layer such that a first layer portion consisting of zinc-iron alloy is formed and on top of said first layer portion a second layer portion consisting of essentially pure unalloyed zinc is formed whereby the thickness of the second layer portion is at least 90% of the total layer thickness, cutting said sheet into a plurality of elongated bands having the zinc layer on both sides and having unprotected edges, and helically wrapping said bands about a cable so as to form an armored cable.

5. A method as claimed in claim 4, characterized in that said applying step comprises the Sendzimir coating process.

* * * * *

UNITED STATES PATENT AND TRADEMARK OFFICE

CERTIFICATE OF CORRECTION

PATENT NO. : 4,439,633

DATED : March 27, 1984

INVENTOR(S) : ALBERTUS T.M. GROOTEN

It is certified that error appears in the above-identified patent and that said Letters Patent is hereby corrected as shown below:

IN THE ABSTRACT: line 7, after "alloy" insert --,--;

line 8, after "portion" delete ","

Claim 1, line 5,(Col. 6, line 8) after "alloy"

insert --,--' line 6,(Col. 6, line 9) after "portion"

delete ",".

Signed and Sealed this

*Twenty-eighth* Day of *August 1984*

[SEAL]

*Attest:*

GERALD J. MOSSINGHOFF

*Attesting Officer*

*Commissioner of Patents and Trademarks*